United States Patent [19]

Harkrader et al.

[11] 3,937,243

[45] Feb. 10, 1976

[54] PRESSURE CONTROL VALVE

[75] Inventors: Ronald L. Harkrader, Saginaw; Dan R. Kimberlin, Frankenmuth, both of Mich.

[73] Assignee: General Motors Corporation, Detroit, Mich.

[22] Filed: Sept. 25, 1974

[21] Appl. No.: 509,247

[52] U.S. Cl. ..... 137/115; 137/118

[51] Int. Cl.[2] ..... G05D 11/03

[58] Field of Search ..... 137/115, 116, 116.3, 116.5, 137/566, 567, 118, 101, 100, 538, 630; 251/31; 91/412, 375, 380

[56] References Cited

UNITED STATES PATENTS

| | | | |
|---|---|---|---|
| 3,024,732 | 3/1962 | Nyman | 137/115 |
| 3,270,763 | 9/1966 | Kiefer | 137/116 |
| 3,640,301 | 2/1972 | Jania | 137/101 |
| 3,817,266 | 6/1974 | Dymond | 137/116 |

*Primary Examiner*—Martin P. Schwadron
*Assistant Examiner*—Robert J. Miller
*Attorney, Agent, or Firm*—Donald F. Scherer

[57] ABSTRACT

A valve for controlling the outlet pressure of a pump which supplies two systems. The valve permits flow through a first regulating portion to the primary system at a pressure equal to the secondary system pressure requirement. The secondary system preferably includes an accumulator and has an upper pressure requirement which is attained when the accumulator is filled. A second regulating portion of the control valve responds to secondary system pressure to permit bypassing of the first regulating portion when the secondary systems upper pressure requirement is satisfied. The second regulating portion closes when the lower limit is reached to permit refilling of the accumulator.

2 Claims, 1 Drawing Figure

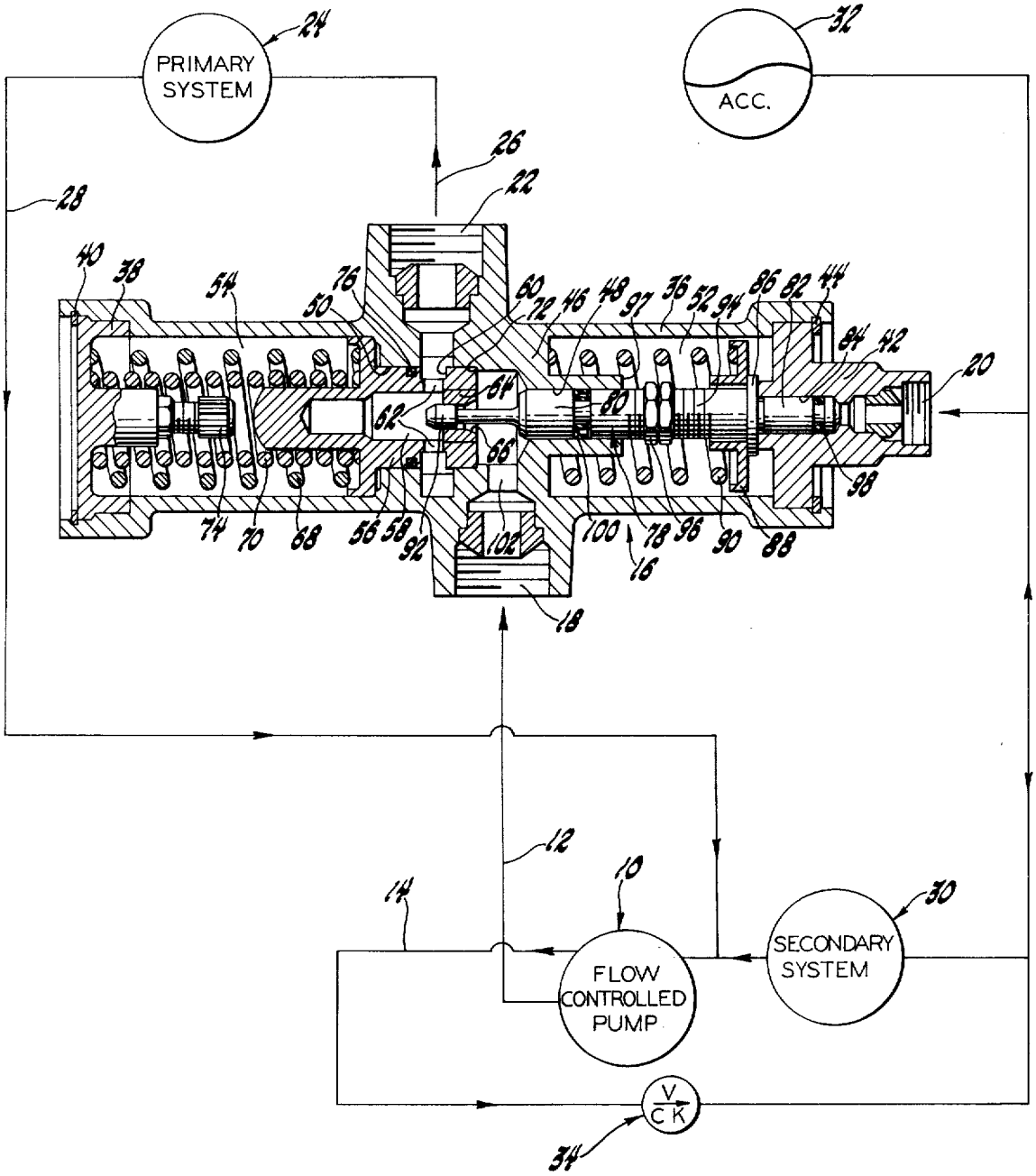
PRIMARY SYSTEM
ACC.
FLOW CONTROLLED PUMP
SECONDARY SYSTEM
V
C K

PRESSURE CONTROL VALVE

This invention relates to pressure control valves and more particularly to pressure control valves for dual pressure systems which control pump pressure in response to the pressure in one system.

When a single pump is used to supply two systems having differing pressure requirements, it is necessary that the pump output pressure, at times, must be higher than the requirement for one of the systems. In most instances, the primary system is a continuous flow system having a fixed flow requirement while the secondary system has a high pressure requirement with low flow. Therefore it is possible to use an accumulator to store fluid under high pressure in the secondary system. The high pressure working cycle in these systems is generally limited to charging the accumulator. When the accumulator is fully charged, it is desirable to reduce the pressure load on the pump until the accumulator pressure is reduced to the lower limit of secondary system pressure.

The present invention uses a single valve structure to control the output pressure of a pump such that the pump pressure is equal to the secondary system pressure requirement during the accumulator charging phase, and is adjusted to primary system pressure when the accumulator is fully charged. The present valve structure is positioned between the pump and the primary system and uses a primary regulator valve to maintain the secondary system requirement. When the secondary system is satisfied, a secondary regulator valve permits uninhibited flow through the primary valve. Since the primary system is downstream of the control valve, this system is not subjected to pressure changes. If a flow controlled primary system is used, the flow control is upstream of the control valve. Since flow control is established by a pressure differential operating valve, the controlled flow is essentially unchanged by the increase in pump pressure because the differential flow control pressure will remain constant. This permits the use of fixed orifice type flow control apparatus.

It is therefore an object of this invention to provide an improved control valve having a primary regulator valve to control pump pressure at a high value and a secondary regulator valve to bypass the primary regulator valve when the high pressure is not required.

Another object of this invention is to provide an improved control valve for use in a single pump supplying primary and secondary systems wherein the control valve maintains the pump pressure at a value equal to the secondary system pressure requirement when the actual secondary system pressure is below said requirement and at primary system pressure when said secondary requirement is satisfied.

A further object of this invention is to provide an improved control valve for a single pump supplying primary and secondary pressure systems wherein coaxially aligned primary and secondary regulator valves are responsive to system pressure to maintain a high pump pressure when a high secondary system pressure is required and a pressure equal to primary system pressure when the secondary system pressure requirement is satisfied.

These and other objects and advantages of the present invention will be more apparent from the following description and drawing which is a cross-sectional view of a control valve and a schematic representation of a fluid system incorporating said valve.

Referring to the drawing, there is shown a conventional flow control pump 10 having a primary output passage 12 and a secondary output passage 14. The pump 10 may be any conventional positive displacement type pump and may utilize either a dual orifice flow control system such as that in U.S. Pat. Nos. 2,799,996 or 3,640,301, or the system may utilize dual flow control type valves such as those shown in U.S. Pat. Nos. 3,620,646; or 3,703,186. The passage 12 is in fluid communication with a pressure control valve 16 which has an inlet port 18, a bias port 20 and an outlet port 22. The inlet port 18 is connected to passage 12, the outlet port 22 is connected to a primary system 24 via passage 26 and to the pump 10 via return passage 28. The passage 14 is connected to the bias port 20, a secondary system 30 and an accumulator 32. The secondary system 30 is also connected to the flow control pump through return passage 28. A check valve 34 is disposed in passage 14 between the pump 10 and the secondary system 30 to permit fluid flow from the pump to the secondary system while preventing reverse flow.

The primary system may be a conventional power steering gear utilized with a motor vehicle such as that shown in U.S. Pat. No. 3,022,772. The secondary system may be a power brake system or an adjustable shock absorbing system commonly used on motor vehicles.

The control valve 16 includes a valve body 36 in which are formed the ports 18 and 22 and also has an end cap 38 secured in fluid tight relationship with the body 36 and positioned therein by a locking ring 40. A second end cap 42 is also disposed in fluid tight relation with the body 36 and is secured therein by a locking ring 44. The end cap 42 has formed therein bias port 20. The body 36 has a central portion 46 in which is formed a first valve bore 48 and a second valve bore 50. The central portion 46 divides the body 36 into two chambers 52 and 54 formed between the central portion 46 and the end cap 42, and between the central portion 46 and the end cap 38 respectively.

A valve member 56 is slidably disposed in the bore 50 and has a central opening 58 in fluid communication with an annular recess 60 via radial passages 62. A valve seat 64 is secured in the valve 56 and has a central opening 66 disposed therein.

A pair of compression springs 68 and 70 are compressed between the end cap 38 and the valve 56 to urge the valve 56 to the right so that the end of valve 56 seats against a shoulder 72 formed in the central portion 46. A valve stop member 74 is threadably secured in the end cap 38 to limit the leftward movement of valve 56. A sealing ring 76 is disposed on the valve 56 to prevent fluid leakage past the outside diameter of valve 56 into chamber 54 which is connected to the flow control pump reservoir by a passage, not shown. Chamber 52 is also connected to the pump reservoir.

A valve spool 78 has a large diameter 80 slidably disposed in valve bore 48 and a smaller diameter 82 slidably disposed in bore 84 formed in the end cap 42. Also formed on the valve 78 is a shoulder portion 86 which is in abutting relation with a spring seat 88 which spring seat 88 is maintained in this relationship by a compression spring 90 disposed in spring chamber 52 between the central portion 46 and the spring seat 88. The spring 90 urges the valve 78 to the right such that the shoulder 86 abuts the end cover 42 and an extending head portion 92 of valve 78 is disposed in the opening 66 of the valve seat 64 thereby preventing fluid flow through said opening.

The valve 78 has a thread portion 94 on which is positioned threaded members 96 which engage a shoulder 97 on the central portion 46 upon leftward movement of the valve 78 to limit such movement. The bore 84 is in fluid communication with passage 14 through port 20. The bore 84 is sealed between port 20 and chamber 52 by a sealing ring 98 disposed on the diameter 82 while the port 18 is sealed from the chamber 52 by an annular sealing ring 100 disposed on the diameter 80.

Fluid is delivered from pump 10 to passages 12 and 14. The fluid in passage 12 passes through port 18 and a radial passage 102 formed in the central portion 46. The fluid passing through passage 102 acts on the right end of valve 56 until the pump pressure is sufficient to move the valve 56 to the left against springs 68 and 70. As the valve 56 moves to the left fluid is directed past the right face of valve 56 to port 22 and hence to the primary system 24 via passage 26.

The fluid in passage 14 is delivered through check valve 34 in the secondary system 30, accumulator 32, and port 20. The fluid pressure in passage 12, at this time, is at the pressure level determined by the force in springs 68 and 70. The pressure in passage 14 is determined by the pressure in accumulator 32. For most operating conditions, this fluid pressure is higher than the pressure required by the primary system 24. The secondary system 30 is designed to operate within a predetermined pressure range, for example 600 to 1,000 PSI, while the primary system operates at 50 to 800 PSI, depending on steer effort, and occasionally at 1100 PSI.

When the accumulator 32 is charged to the maximum secondary system pressure the fluid pressure in passage 14 acting on the right end of diameter 82 will move the valve 78 to the left against spring 90 thereby opening a flow relationship between ports 18 and 22 through the central opening 66. When the central opening 66 is opened, the output pressure of pump 10 will decrease to the value equal to the primary system requirement. Thus, the pressure acting in the right hand direction of the differential area between head 92 and diameter 80 will be reduced, thus reducing the rightward force on the valve 78. Due to the reduction in pressure force on the valve 78, the valve 78 will not be moved to the right by spring 90 until the pressure in the accumulator 32 has been reduced to the minimum value of the secondary system pressure requirement.

The check valve 34 will be closed by fluid pressure in the secondary system when the valve 78 is moved to the left thereby preventing reverse flow from the secondary system 30 to the pump 10. Also, as the valve 78 is moved to the left, the pressure forces on valve 56 are reduced thus permitting the valve 56 to return to the spring set position shown. At this time fluid flow from the pump to the primary system 24 will be through passage 102, opening 66, passages 62, and port 22. The check valve 34 can be replaced with an unloaded valve such as that shown in U.S. Pat. No. 2,264,375 if desired.

When the secondary system pressure is reduced to the minimum pressure requirement, the valve 78 will be moved to the right by spring 90 until the head 92 seals the opening 66. At this time, the output pressure of output pump 10 will be again increased to the level established by springs 68 and 70, and will remain at this higher level until the secondary system accumulator 32 is recharged to the maximum value.

Obviously, many modifications and variations of the present invention are possible in light of the above teachings. It is, therefore, to be understood that within the scope of the appended claims the invention may be practiced otherwise than as specifically described.

We claim:

1. A control valve for controlling the output pressure of a pump which supplies fluid to a primary system having a continuous flow requirement and variable pressure requirements, and to a secondary system including an accumulator having a pressure requirement range, the control valve comprising; axially movable first pressure responsive valve means in fluid communication with said pump for controlling the output pressure at a level within the accumulator pressure requirement range and having an axially movable valve element with a valve seat thereon and a central axial opening in said valve seat for directing the flow requirement to the primary system downstream of said first pressure responsive valve means at the pressure level required by the primary system; and second pressure responsive valve means coaxially aligned with said first pressure responsive valve means and being in fluid communication with and responsive to the accumulator pressure to move axially relative to the first pressure responsive valve means and having an axially extending portion in nesting relation with said central axial opening in said valve seat for bypassing the primary system flow requirement through said central axial opening in said first pressure responsive valve means to said primary system thereby establishing the output pressure of the pump equal to the primary system pressure requirement when the accumulator pressure is equal to the maximum level of the accumulator pressure requirement range, and for preventing bypassing through said first pressure responsive valve means when the accumulator pressure is equal to the minimum level of the accumulator pressure requirement range thereby returning control of the output pressure to said first pressure responsive valve means.

2. A control valve for controlling the system pressure of a pump supplying fluid to a primary system having a continuous flow requirement and variable pressure requirements, and to a secondary system including an accumulator having a pressure requirement range, the combination comprising; a valve body, an inlet port in fluid communication with the pump, an outlet port in fluid communication with the primary system, first valve means slidably disposed in said valve body between said inlet and outlet ports, first spring means urging said first valve means in one direction for maintaining the system pressure at a level within the accumulator pressure requirement range and for permitting the first valve means to open to allow the flow requirement to leave the outlet port at the pressure level required by the primary system, a central opening in said first valve means, a second valve means slidably disposed in said valve body, a head portion on said second valve means extending into said central opening, second spring means urging said head portion into said central opening to close said opening, and a bias port in fluid communication with said secondary system and said secondary valve means, said secondary system pressure being operable on said second valve means for opening said central opening for bypassing the primary system flow requirement through said central opening and said outlet port to said primary system to establish the system pressure equal to the primary system pressure requirement when the accumulator pressure is equal to the maximum level of the accumulator pressure requirement range, and said second spring means being operable on said second valve means to close said central opening for preventing bypassing of said primary system flow requirement when the accumulator pressure is equal to the minimum value of the accumulator pressure requirement range thereby returning control of the system pressure to said first valve means.

* * * * *